US006625971B2

(12) United States Patent
Graves

(10) Patent No.: US 6,625,971 B2
(45) Date of Patent: Sep. 30, 2003

(54) FUEL NOZZLE PRODUCING SKEWED SPRAY PATTERN

(75) Inventor: Charles B. Graves, South Windsor, CT (US)

(73) Assignee: United Technologies Corporation, Hartford, CT (US)

( * ) Notice: Subject to any disclaimer, the term of this patent is extended or adjusted under 35 U.S.C. 154(b) by 0 days.

(21) Appl. No.: 09/952,747

(22) Filed: Sep. 14, 2001

(65) Prior Publication Data

US 2003/0051480 A1 Mar. 20, 2003

(51) Int. Cl.[7] ..... F02C 1/00

(52) U.S. Cl. ..... 60/39.06; 60/734; 239/599; 239/601; 431/9

(58) Field of Search ..... 60/740, 734, 735, 60/742, 748; 431/8, 9, 159, 181, 187, 188; 239/597, 599, 601, 533.3–533.12

(56) References Cited

U.S. PATENT DOCUMENTS

| | | | | | |
|---|---|---|---|---|---|
| 2,607,193 | A | | 8/1952 | Berggren et al. | 60/39.74 |
| 4,273,291 | A | | 6/1981 | Muller | 239/533.12 |
| 4,638,636 | A | * | 1/1987 | Cohen | 60/741 |
| 4,646,977 | A | * | 3/1987 | Iwamura et al. | 239/590.5 |
| 4,957,242 | A | * | 9/1990 | Schadow et al. | 239/590 |
| 4,986,478 | A | | 1/1991 | Bertini | 239/585 |
| 4,991,398 | A | | 2/1991 | Clark et al. | 60/748 |
| 5,060,867 | A | | 10/1991 | Luxton et al. | 239/428.5 |
| 5,109,823 | A | * | 5/1992 | Yokoyama et al. | 123/472 |
| 5,109,824 | A | * | 5/1992 | Okamoto et al. | 123/472 |
| 5,267,442 | A | | 12/1993 | Clark | 60/748 |
| 5,465,571 | A | | 11/1995 | Clark | 60/39.32 |
| 5,490,378 | A | * | 2/1996 | Berger et al. | 60/39.23 |
| 5,577,481 | A | * | 11/1996 | Wahba | 123/470 |
| 5,622,489 | A | * | 4/1997 | Monro | 431/187 |
| 5,966,937 | A | | 10/1999 | Graves | 60/748 |
| 6,220,034 | B1 | | 4/2001 | Mowill | 60/737 |

FOREIGN PATENT DOCUMENTS

| | | |
|---|---|---|
| EP | 0678667 | 10/1995 |
| EP | 0742366 | 11/1996 |
| EP | 0849530 | 6/1998 |
| EP | 1036933 | 9/2000 |
| GB | 2016592 | 9/1979 |
| WO | 0050766 | 8/2000 |

* cited by examiner

*Primary Examiner*—Charles G. Freay
*Assistant Examiner*—Han L Liu
(74) *Attorney, Agent, or Firm*—Brian J. Hamilla

(57) ABSTRACT

A fuel nozzle, comprising an inlet for receiving fuel and an outlet for discharging fuel. The outlet intersects a longitudinal centerline of the nozzle and produces a skewed spray pattern. A fuel injector having a fuel nozzle outlet such that a fluid discharged from a swirler produces a crescent-shaped spray pattern in the fuel. A burner section of a gas turbine engine comprising a combustion chamber and fuel injectors. At least one of the fuel injectors produces a skewed flame pattern in the combustion chamber that overlaps with a flame pattern from an adjacent fuel injector. A method of improving stability of a flame in a burner section of a gas turbine engine in which at least one of the fuel injectors produces a skewed flame pattern in the burner section to create a fuel non-uniformity, the flame pattern also overlapping with an adjacent flame pattern.

26 Claims, 4 Drawing Sheets

FIG.7
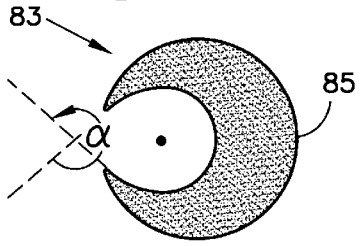
FIG.8
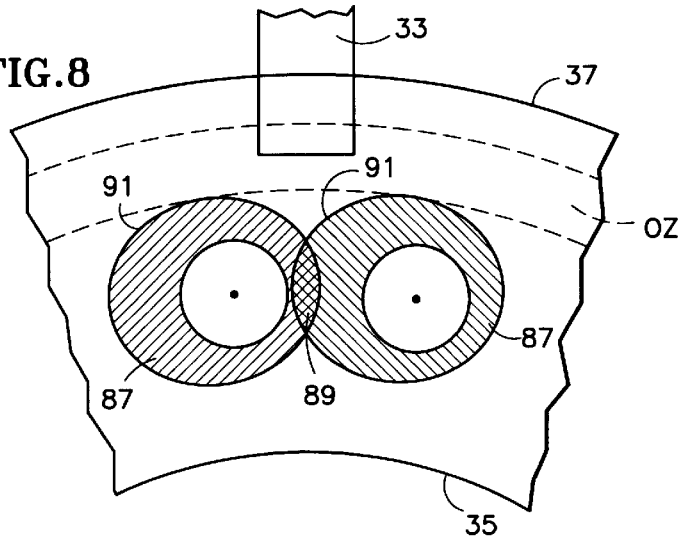
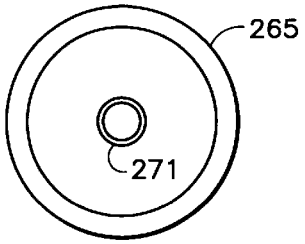
FIG.9
FIG.11
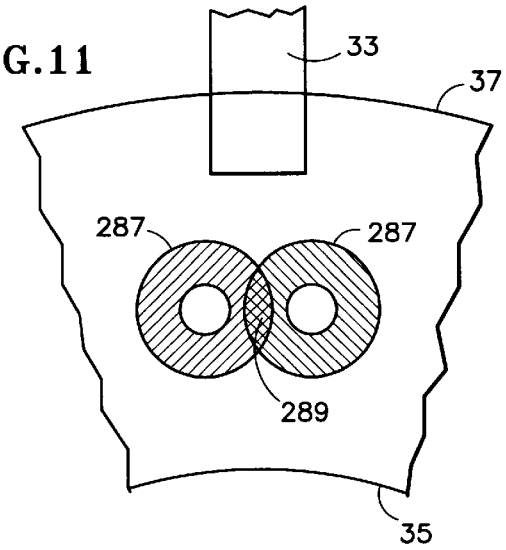
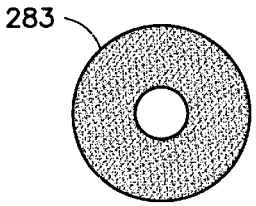
FIG.10
FIG.13
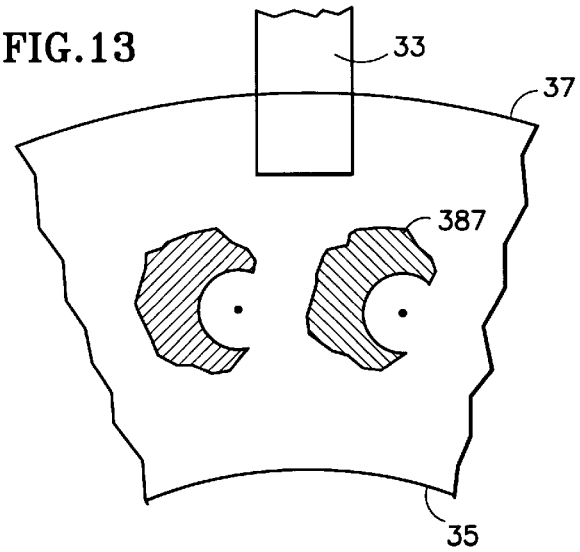
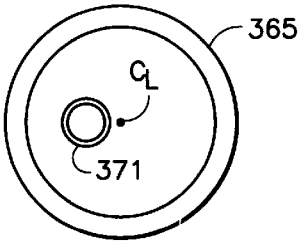
FIG.12

FUEL NOZZLE PRODUCING SKEWED SPRAY PATTERN

GOVERNMENT RIGHTS

The U.S. Government may have rights in this invention pursuant to Contract Number N00019-97-C-0050 with the U.S. Navy.

TECHNICAL FIELD

This invention relates to a fuel injector used in a burner section of a gas turbine engine. More particularly, this invention relates to a fuel nozzle that produces a skewed fuel spray pattern.

BACKGROUND OF THE INVENTION

Each successive generation of gas turbine engine typically represents a marked improvement over the earlier generations. Various factors, such as environmental impact and perceived customer requirements, help spur the improvements in a new generation of engine. A burner section of the engine, where the combustion of the fuel occurs, is no exception to the need for improvement.

A designer must consider many factors when developing the next generation burner section of a gas turbine engine. Such factors include fuel/air ratio operating range, smoke-free temperature rise capability, lean blow out, NOx emissions, stability, complexity, weight and cost. Up to this point, a solution that benefited one factor may have been a significant detriment to another factor. For example, a designer might consider using a double annular combustor rather than a single annular combustor to increase the operating range of the fuel/air ratio and to improve lean blow out. However, such a solution impacts other factors—namely weight, complexity and cost.

DISCLOSURE OF THE INVENTION

It is an object of the present invention to provide an improved burner section of a gas turbine engine.

It is a further object of the present invention to provide an improved fuel injector within the burner section.

It is a further object of the present invention to provide an improved fuel nozzle within the fuel injector.

It is a further object of the present invention to provide an improved primary fuel circuit within the fuel nozzle.

It is a further object of the present invention to provide a fuel nozzle that exhibits an improvement in one or more characteristics of the engine without significantly impacting any of the other characteristics of the engine.

It is a further object of the present invention to provide a fuel nozzle that improves lean stability.

It is a further object of the present invention to provide a fuel nozzle capable of increasing the temperature rise capability of the combustion chamber.

It is a further object of the present invention to provide a fuel nozzle that exhibits a lower fuel/air ratio at lean blowout, and provides a higher operating range.

These and other objects of the present invention are achieved in one aspect by a fuel nozzle, comprising: an inlet for receiving fuel; and an outlet for discharging fuel. The outlet intersects the longitudinal centerline of the nozzle and produces a skewed spray pattern.

These and other objects of the present invention are achieved in another aspect by a fuel injector, comprising: a fuel nozzle having an outlet for discharging fuel; and a swirler adjacent the fuel nozzle. The swirler discharges a fluid concentric with the outlet of the fuel nozzle. The fluid discharged from the swirler produces a crescent-shaped spray pattern in the fuel discharged from the fuel nozzle.

These and other objects of the present invention are achieved in another aspect by a burner section of a gas turbine engine, comprising: a combustion chamber; and a plurality of fuel injectors for providing fuel to said combustion chamber. At least one of the fuel injectors produces a skewed flame pattern in the combustion chamber that overlaps with a flame pattern from an adjacent fuel injector.

These and other objects of the present invention are achieved in another aspect by a method of improving stability of a flame in a burner section of a gas turbine engine. The method comprises the steps of: providing a plurality of fuel injectors; supplying fuel to the fuel injectors so that at least one of the fuel injectors produces a skewed flame pattern in the burner section, the skewed flame pattern creating a fuel non-uniformity in the burner section; and overlapping the skewed flame pattern with a flame pattern of an adjacent fuel injector.

BRIEF DESCRIPTION OF THE DRAWINGS

Other uses and advantages of the present invention will become apparent to those skilled in the art upon reference to the specification and the drawings, in which:

FIG. 7 is a plan view of a spray pattern created by the opening in the distal end of the inner sleeve of FIG. 6;

FIG. 8 is a view from within the combustion chamber and taken along line VIII—VIII of FIG. 2, showing the flame pattern created by two adjacent fuel nozzles;

FIG. 9 is a plan view of the distal end of an inner sleeve of another type of fuel nozzle;

FIG. 10 is a plan view of a spray pattern created by the opening in the distal end of the inner sleeve of FIG. 9;

FIG. 11 is a view from within a combustion chamber of an engine, showing the flame pattern created by two adjacent fuel nozzles such as those seen in FIG. 9;

FIG. 12 is a plan view of the distal end of an inner sleeve of another type of fuel nozzle;

FIG. 13 is a view from within a combustion chamber of an engine, showing the flame pattern created by two adjacent fuel nozzles such as those seen in FIG. 12.

BEST MODE FOR CARRYING OUT THE INVENTION

Figure 1:
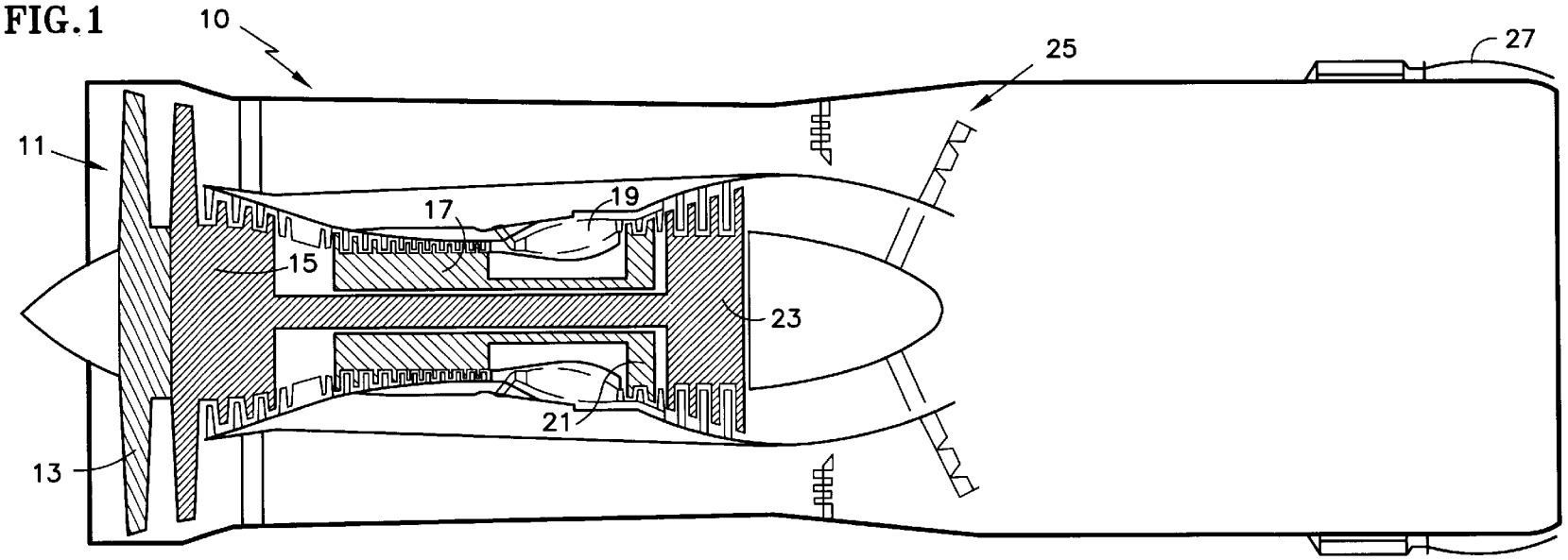
FIG. 1 is a cross-sectional view of a turbofan engine.

FIG. 1 provides a cross-sectional view of a gas turbofan engine 10. Starting at the upstream end, or inlet 11, the major components of the engine 10 may include a fan section 13, a low pressure axial compressor 15, a high pressure axial compressor 17, a burner section 19, a high pressure turbine 21, a low pressure turbine 23, an afterburner 25 and a nozzle 27. Generally speaking, the engine 10 operates as follows. Air enters the engine 10 through the inlet 11, travels past the fan section 13, becomes compressed by the compressors 15, 17, mixes with fuel, and combusts in the burner section 19. The gases from the burner section 19 drive the turbines 21, 23, then exit the engine 10 through the nozzle 27. If necessary, the afterburner 25 could augment the thrust of the engine 10 by igniting additional fuel. Components of the engine 10 unrelated to the present invention are not discussed further.

Figure 2:
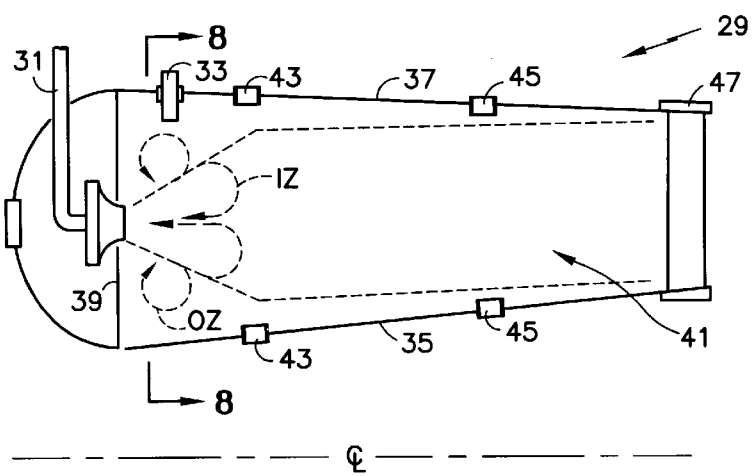
FIG. 2 is a detailed cross-sectional view of a burner section of the turbofan engine of FIG. 1.

FIG. 2 is a detailed cross-sectional view of a portion of the burner section 19. The burner section 19 includes an annular combustor 29, fuel injectors 31 and spark igniters 33. The igniters 33 light the fuel/air mixture provided to the combustor 29 from the fuel injectors 31 during engine start.

The annular combustor 29 includes an inner liner 35, an outer liner 37, and a dome 39 joining the inner liner 35 and the outer liner 37 at an upstream end. A cavity 41 formed between the inner liner 35 and the outer liner 37 defines the combustion chamber.

The fuel injectors 31 mount to the dome 39. The fuel injectors 31 provide fuel and air to the cavity 41 for combustion. The inner liner 35 and the outer liner 37 have combustion holes 43 and dilution holes 45 to introduce secondary air to the cavity 41. The combustion holes 43 and dilution holes 45 aid the combustion process, create a more uniform exit temperature, control the rate of energy release within the combustion chamber to help reduce emissions, and keep the flame away from the inner liner 35 and the outer liner 37. Guide vanes 47 at the downstream end of the combustion chamber define the entrance to the high pressure turbine 21.

The expansion of the flow past the dome 39 and into the combustion chamber, along with the swirl created by the fuel injector 31, creates toroidal recirculation zones. As seen in FIG. 2, the combustion chamber has an outer recirculation zone OZ and an inner recirculation zone IZ. The recirculation zones OZ, IZ bring hot combustion products upstream to mix with the uncombusted flow entering the combustion chamber. The hot combustion products provide a continuous ignition source for the fuel spray exiting the fuel injectors 31.

The engine 10 operates at a wide variety of power levels. Accordingly, the fuel injectors 31 must control fuel flow to meet these varied fuel demands. At high power levels, which create the greatest demand for fuel, the fuel injectors 31 will supply the most amount of fuel to the engine 10. Conversely, the fuel injectors 31 supply the least amount of fuel to the engine 10 at low power levels, such as at engine start, idle and snap deceleration.

The fuel injectors 31 use a dual circuit design to meet such variable fuel demand. A primary fuel circuit continuously supplies fuel to the engine 10 regardless of power level. A secondary fuel circuit supplies fuel to the engine 10 only at high power levels. Generally speaking, a high power level is a power setting above idle.

Figure 3:
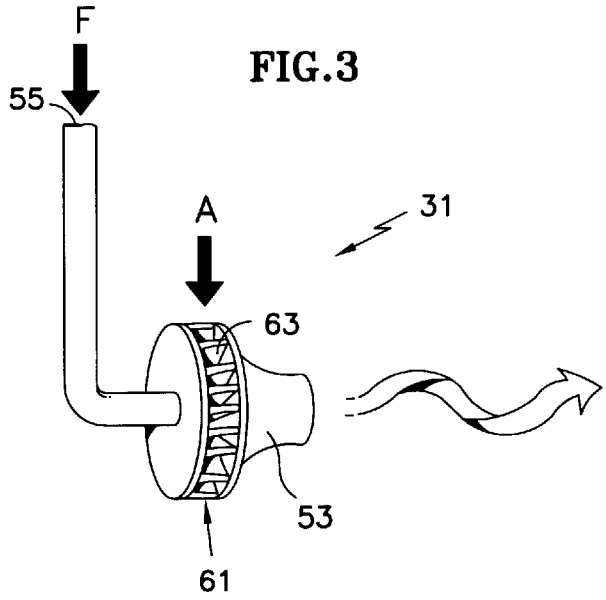
FIG. 3 is a perspective view of a fuel injector used in the turbofan engine of FIG. 1.

FIG. 3 is a perspective view of the fuel injector 31. The fuel injector 31 includes a fuel nozzle 51 and a swirler 53 surrounding the fuel nozzle 51. Fuel F enters an inlet 55 in the injector 31 and exits through outlets (see FIG. 4) in the nozzle 51. The fuel nozzle 51 typically mounts to the diffuser case (not shown) of the engine 10. The swirler 53 typically either rigidly mounts to the dome 39 of the combustion chamber or slidably mounts to the dome 39. During engine assembly, the fuel nozzle 51 slides into the swirler 53.

The swirler 53 concentrically surrounds the nozzle 51. The swirler 53 has a passageway 61 with angled vanes 63 therein to impart a rotation to the air A supplied by the compressors 15, 17. Preferably, the direction of rotation is counterclockwise. The rotating air A impinges the fuel spray and imparts a rotation to the fuel. The vortex created by the swirler 53 helps control the flame in the combustion chamber.

Figure 4:
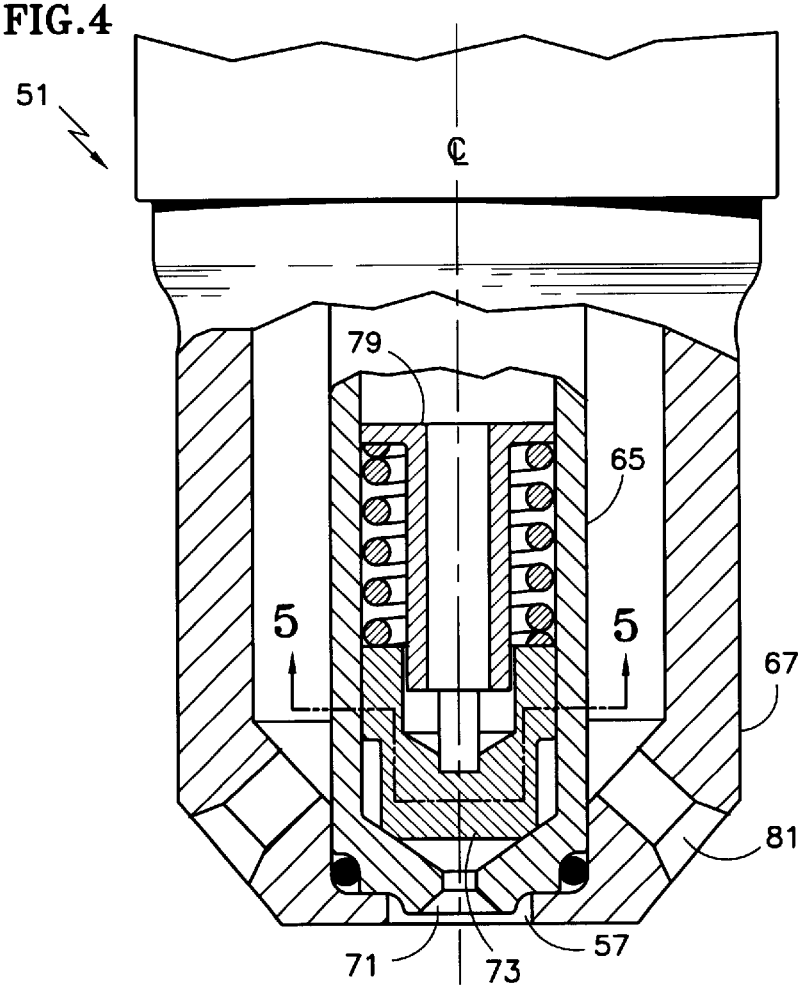
FIG. 4 is a side view, in partial cross-section, of a portion of a fuel nozzle of the fuel injector of FIG. 3.

FIG. 4 shows a side view, in partial cross-section, of one possible embodiment of the fuel nozzle 51 (without the swirler 53 attached). The fuel nozzle 51 includes an inner sleeve 65 used for the primary fuel circuit and an outer sleeve 67 used for the secondary fuel circuit.

The primary circuit fuel travels within the inner sleeve 65 towards a distal end having a conical taper. The primary circuit fuel exits through an outlet in the distal end of the inner sleeve 65. Preferably, the outlet in the inner sleeve 65 is a metering orifice 71 that intersects the longitudinal centerline CL of the fuel nozzle 51 (and the longitudinal centerline of the swirler 53 since the swirler 53 is concentric with the fuel injector 31).

A plug 73 resides within the inner sleeve 65 near the metering orifice 71. The plug 73, acting as a baffle, helps regulate the supply of fuel to the metering orifice 71. A cap 79 attached to the inner sleeve 65 spring biases the plug 73 against the distal end of the inner sleeve.

Figure 5:
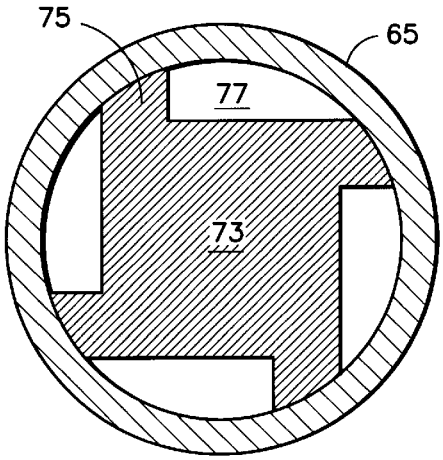
FIG. 5 is a cross-sectional view of the distal end of the fuel nozzle taken along line V—V in FIG. 4.

FIG. 5 provides a detailed cross-sectional view of the interaction between the inner sleeve 65 and the plug 73. In this embodiment, the plug 73 is uniform and includes a plurality of extensions 75. The extensions 75 abut the inner diameter of the sleeve 65 to define a plurality of uniformly sized and spaced fuel passages 77 through which the fuel passes before entering the metering orifice 71.

The secondary circuit fuel travels within the outer sleeve 67. Specifically, the secondary circuit fuel travels within the annular void between the inner diameter of the outer sleeve 67 and the outer diameter of the inner sleeve 65. The secondary circuit fuel exits the outer sleeve 67 through a plurality of metering orifices 81 in a distal end of the outer sleeve 67. The metering orifices 81 are concentrically located around the longitudinal centerline CL of the fuel nozzle 51.

Although FIG. 4 shows one type of secondary circuit for the fuel nozzle 51 (i.e. using individual metering orifices 81), the present invention could use other secondary circuit arrangements. For example, the secondary fuel circuit could have a single annular orifice (not shown) extending around the entire circumference of the distal end of the medial sleeve 67. Or, the secondary circuit could be an air blast secondary circuit. An air blast secondary circuit uses additional sleeves (not shown) with annular orifices (not shown) for ejecting pressurized air. The air blasts preferably surround (i.e. radially inward and radially outward) the annular secondary circuit fuel spray. The air blasts help atomize the fuel.

The outer sleeve 67 includes an opening 57 aligned with the metering orifice 71 in the inner sleeve 65. The opening 57 allows the metered fuel to exit the nozzle 51 without interference.

At high power levels, all of the metering orifices 71, 81 supply fuel to the combustion chamber. As mentioned earlier, high power can be any power setting above idle. At such high power levels, as much as approximately 90% of total fuel flow passes through the secondary fuel circuit (i.e. metering orifices 81). Conversely, the primary fuel circuit (i.e. metering orifice 71) accounts for the remaining approximately 10% of total fuel flow during such high power conditions.

At low power levels, the fuel control system could stop fuel flow to metering orifices 81, leaving only flow to metering orifice 71. In other words, the fuel control system would route 100% of the total fuel flow through the metering orifice 71. Alternately, the fuel control system could reduce the fuel flow to the metering orifices 81. Rather than stopping fuel flow, the fuel control system would allow a minimal amount (e.g. 10% or less) of the total fuel flow to pass through the metering orifices 81. The dominant portion of total fuel flow (e.g. at least 90%) would travel through metering orifice 71.

Figure 6:
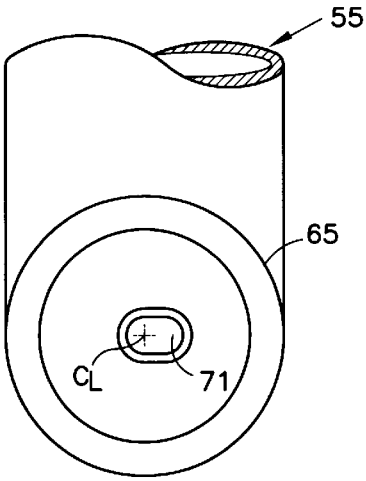
FIG. 6 is a front view of an inner sleeve of the fuel nozzle of FIG. 4, showing an opening in the distal end.

As discussed above, the fuel nozzle 51 of the present invention creates a skewed fuel spray pattern. Specifically, the primary fuel circuit of the fuel nozzle 51 produces the skewed fuel spray pattern. The skewed fuel spray pattern of the primary fuel circuit produces a non-uniformity in the fuel/air ratio within the combustion chamber. FIG. 6 provides a first alternative method of creating the skewed fuel spray pattern.

FIG. 6 is a front view of the inner sleeve 65. The skewed fuel spray pattern occurs because the metering orifice 71 is not a perfect circle. Instead, the metering orifice 71, while still intersecting along the longitudinal centerline CL, has an eccentric shape. Preferably, the metering orifice 71 has an elongated shape, such as an oblong. FIG. 6 also displays the orientation of the oblong orifice 71 relative to the remainder of the fuel nozzle body. This orientation ensures that the swirler 53 will bring fuel to the ignitors 33 and will cause excess fuel to concentrate in the vicinity of liner 37.

Figure 6A:
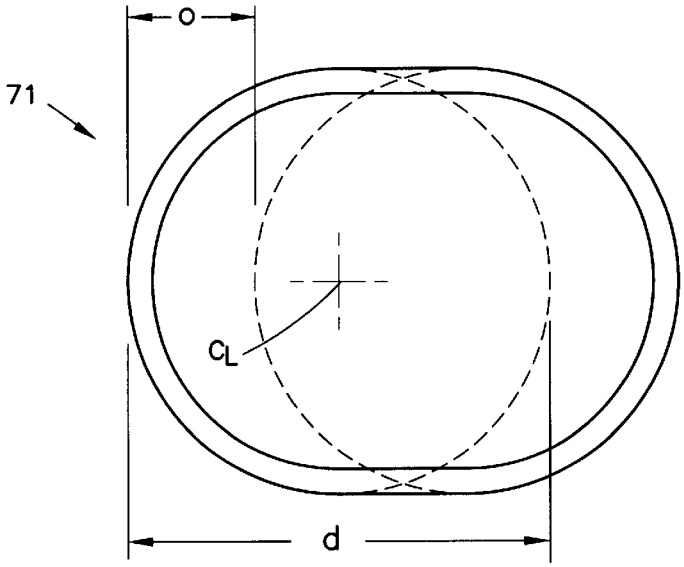
FIG. 6*a* is a detailed view of the opening in the distal end of the inner sleeve of FIG. 6.

FIG. 6*a* is a detailed view of the metering orifice 71. Preferably, two overlapping circles define the elongated shape of the metering orifice 71. At least one of the circles, and preferably both, has a diameter d. One circle is preferably concentric with the longitudinal centerline CL of the fuel nozzle 51. The other circle preferably has an offset o from the first circle (and from the longitudinal centerline). The offset should be less than about 0.5 d, and preferably approximately 0.25 d. Although described as an oblong, other shapes and arrangements of the metering orifice 71 could be used to produce a skewed fuel spray pattern.

For comparison, FIGS. 9 and 12 demonstrate two embodiments of primary fuel circuits of other types of nozzles. As shown in FIG. 9, an inner sleeve 265 of the conventional nozzle has a circular metering orifice 271. The metering orifice 271 is concentric with the longitudinal centerline of the nozzle.

As shown in FIG. 12, an inner sleeve 365 of the conventional nozzle has a metering orifice 371 offset from the longitudinal centerline CL of the nozzle. In other words, the orifice 371 does not intersect the longitudinal centerline CL of the nozzle. Although shown as circular, the metering orifice 371 could have other shapes. For instance, U.S. Pat. No. 5,267,442 describes an elongated orifice.

FIG. 7 displays a fuel spray pattern 83 created by the metering orifice 71 of the present invention and without interaction from the swirler 53. Preferably, the spray pattern 83 is in the shape of a crescent. The crescent-shaped spray pattern 83 should occupy an arc having an angle $\alpha$ of greater than approximately 245°. Preferably, the angle $\alpha$ is approximately 270°. Although described as a crescent shape, the present invention could create skewed spray patterns defined by other shapes.

The crescent shape of the spray pattern 83 creates an area 85 of greatest, or peak, fuel concentration. Generally speaking, the peak fuel concentration 85 is located at the midpoint of the crescent. The portion of the metered orifice 71 offset from the longitudinal centerline is responsible for creating the peak fuel concentration 85 in the spray pattern 83. The fuel injector 51 is positioned so that the peak area 85 (which, upon interaction from the swirler 53 and upon ignition, creates a corresponding peak flame area) reaches a selected position within the combustion chamber to help stabilize the flame within the combustor 29. This feature will be discussed in more detail below.

FIG. 8 is a view, looking in the downstream direction, of one section of the combustion chamber. The figure displays flame patterns 87 of two adjacent fuel nozzles 31. Ignition of the skewed fuel spray pattern 83 likewise produces a skewed flame pattern 87. The arrangement of the fuel nozzles 31 in the combustor 29 creates an overlap 89 between adjacent flame patterns 87.

The flame patterns 87 of the present invention display an area 91 having the greatest, or peak, flame concentration. Preferably, the peak flame concentration 91 is adjacent a recirculation zone in the combustion chamber for flame stabilization. As seen in FIG. 8, the peak flame concentration 91 faces the outer recirculation zone OZ. The peak flame concentration 91 is also positioned adjacent the overlap 89. The benefits of orienting the peak flame concentration 91 in such a manner become clear upon a comparison with other types of nozzles.

For comparison, FIGS. 10, 11, 13 and 14 demonstrate the fuel spray patterns and flame patterns of the two other types of nozzles. The metering orifice 271 shown in FIG. 9 produces a symmetrical fuel spray pattern 283, preferably a toroid as shown in FIG. 10. Ignition of the fuel spray pattern 283 likewise produces a flame pattern 287 in the shape of a toroid as shown in FIG. 11. Adjacent flame patterns 287 may form an overlap 289.

The metering orifice 371 shown in FIG. 12 produces a symmetrical fuel spray pattern similar to the spray pattern 283. Due to the offset from longitudinal centerline, however, the impingement of the swirler vortex on the fuel spray pattern produces a flame pattern 387 such as that shown in FIG. 13. The flame pattern 387 of the conventional fuel nozzle 351 occupies a narrow arc of less than 180°. Note that adjacent flame patterns 387 do not overlap. Instead, discrete areas exist between adjacent flame patters. Due to the lack of overlap, these discrete areas define cold regions within the combustion chamber.

Clearly, the positioning of the peak flame concentration 91 is an important aspect of the present invention. Comparing the location of the peak fuel concentration 85 in FIG. 7 to the location of the peak flame concentration 91 in FIG. 8, the impact of the vortices created by the swirlers 53 is easily seen. The swirler vortex has rotated the peak flame concentration 91 from the location of the peak fuel concentration 85. Since the swirler 53 creates a counterclockwise vortex, the peak flame concentration 91 is rotated counterclockwise from the peak fuel concentration 85.

In order for the peak flame concentration 91 to be located adjacent the desired recirculation zone and to define the overlap 89, the peak fuel concentration 85 must be arranged at a rotationally upstream position. With the counterclockwise swirler 53, the peak fuel concentration 85 is preferably rotated clockwise relative to the desired position of the peak flame concentration 91. The specific amount of rotation depends, for example, on the rotational speed of the vortex and the longitudinal distance away from the nozzle 51.

The arrangement of the fuel injectors 31 of the present invention provides several improvements over conventional fuel nozzles. First, overlapping flame patterns 85 from adjacent fuel injectors 31 allows for heat transfer therebetween. Such heat transfer could allow for a decrease in the fuel/air ratio at lean blowout of approximately 30%. In addition, by placing the peak flame concentration 91 near the overlap 89, the engine 10 could exhibit a further 20–30% reduction in the fuel/air ratio at lean blowout. This further reduction is possible since the peak flame concentration 91 increases the temperature within the overlap 89.

Second, placing the peak flame concentration 91 adjacent the outer recirculation zone OZ creates higher temperatures in the outer recirculation zone OZ. Since the peak flame concentration 91 exhibits the highest temperature of the skewed flame pattern 87, the outer recirculation zone will also exhibit a higher temperature. The outer recirculation zone OZ transports this high temperature upstream within the combustion chamber to mix with the uncombusted flow entering the combustion chamber. This improves the lean stability of the engine 10.

Despite the non-uniform fuel/air ratio in the primary circuit, the engine 10 still provides adequate smoke characteristics at high power. Specifically, the secondary fuel circuit ensures adequate smoke characteristics. Differently than the primary circuit, the secondary circuit provides a uniform fuel/air ratio to the combustion chamber. At high power, the fuel flow through the primary circuit is insignificant—accounting for only approximately 10% of total fuel flow. The remaining approximately 90% of total fuel flow travels through the secondary circuit. Since the significant portion of total fuel flow to the combustion chamber is at a uniform fuel/air ratio, excessive smoke is not produced. The present invention also achieves these smoke characteristics without a significant increase in NOx emissions.

Figure 5A:
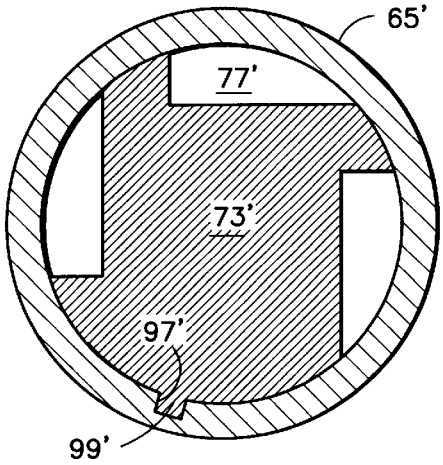
FIG. 5*a* is a cross-sectional view of an alternative embodiment of the distal end of the fuel nozzle.

A second alternative method of creating the skewed fuel spray pattern in the primary fuel circuit involves changing the shape of the plug 73 within the inner sleeve 65. Specifically, the shape of the plug is altered to create a non-uniform arrangement of fuel passages. FIG. 5*a* displays one possible shape for a modified plug 73'. The plug 73' creates a non-uniform arrangement of fuel passages 77' by removing one passage. Instead of eliminating one passageway, another alternative (not shown) would be to reduce the size of the fuel passageway. In either alternative, the arrangement of the fuel passages produces the non-uniform fuel flow through the metering orifice (which may be elongated as described above, or merely circular). This non-uniform fuel flow produces the skewed spray pattern.

To ensure proper alignment of the plug 73' within the inner sleeve 65', the inner sleeve 65' could have a keyway 97' that receives a spine 99' extending from the plug 73'. This allows the fuel spray pattern 83 to be located so that the peak flame concentration 91 is aligned with the outer recirculation zone OZ.

The present invention has been described in connection with the preferred embodiments of the various figures. It is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A fuel nozzle having for a fuel injector, said fuel nozzle having a longitudinal centerline, the fuel nozzle comprising:

an inlet for receiving fuel; and an outlet for discharging fuel;

wherein said outlet intersects the longitudinal centerline, but is offset from the longitudinal centerline and produces a skewed spray pattern.

2. The fuel nozzle as recited in claim 1, wherein said outlet has a metering orifice with an eccentric shape.

3. The fuel nozzle as recited in claim 2, wherein said eccentric shape comprises overlapping circles.

4. The fuel nozzle as recited in claim 3, wherein one of said overlapping circles has a diameter (d), and an amount of offset between said circles is less than approximately 0.5 d.

5. The fuel nozzle as recited in claim 4, wherein said amount of offset is approximately 0.25 d.

6. The fuel nozzle as recited in claim 1, wherein said outlet further comprises a metering orifice and a plug adjacent said metering orifice, said plug having fuel passages in a non-uniform arrangement.

7. A fuel injector, comprising:

a fuel nozzle having an outlet for discharging fuel; and a swirler adjacent said fuel nozzle and having an outlet for discharging a fluid concentric with said outlet of said fuel nozzle;

wherein said swirler discharges the fluid to produce a crescent-shaped spray pattern in the fuel discharged from said outlet of said fuel nozzle.

8. The fuel injector as recited in claim 7, wherein said crescent-shaped spray pattern occupies an arc of greater than approximately 245°.

9. The fuel injector as recited in claim 8, wherein said crescent-shaped spray pattern occupies an arc of approximately 270°.

10. The fuel injector as recited in claim 7, wherein said outlet has a metering orifice in a shape of overlapping circles.

11. The fuel injector as recited in claim 7, wherein said outlet comprises a metering orifice and a plug adjacent said metering orifice, said plug having fuel passages in a non-uniform arrangement.

12. A burner section of a gas turbine engine, comprising:

a combustion chamber; and a plurality of fuel injectors for providing fuel to said combustion chamber;

wherein at least one of said fuel injectors produces a skewed flame pattern in said combustion chamber, said flame pattern having an overlap with a flame pattern from an adjacent one of fuel injectors.

13. The burner section as recited in claim 12, wherein said fuel injector has a metering orifice for discharging fuel, said outlet having an eccentric shape.

14. The burner section as recited in claim 12, wherein said skewed flame pattern is crescent-shaped.

15. The burner section as recited in claim 12, wherein said combustion chamber has a recirculation zone, said skewed flame pattern having a peak flame concentration adjacent said recirculation zone.

16. The burner section as recited in claim 15, wherein said recirculation zone comprises an outer recirculation zone and an inner recirculation zone, said peak flame concentration adjacent said outer recirculation zone.

17. The burner section as recited in claim 15, wherein said peak flame concentration is also adjacent said overlap.

18. The burner section as recited in claim 12, wherein said fuel injector has a longitudinal centerline and an outlet for discharging fuel, said outlet intersecting said longitudinal centerline.

19. A method of improving stability of a flame in a burner section of a gas turbine engine, comprising the steps of:

providing a plurality of fuel injectors;

supplying fuel to said fuel injectors so that at least one of said fuel injectors produce a skewed flame pattern in the burner section, said skewed flame pattern creating a fuel non-uniformity in the burner section; and overlapping said skewed flame pattern with a flame pattern of an adjacent one of said fuel injectors.

20. The method as recited in claim 19, wherein said fuel injector has a primary circuit and a secondary circuit, said skewed fuel flame pattern produced by said primary circuit.

21. The method as recited in claim 19, wherein skewed flame pattern has a peak flame concentration, and further comprising the step of placing said peak flame concentration adjacent an overlap between said skewed flame patterns.

22. The method as recited in claim 21, wherein the burner section has a recirculation zone, and further comprising the step of placing said peak flame concentration adjacent said recirculation zone.

23. A burner section of a gas turbine engine, comprising:

a combustion chamber; and a plurality of fuel injectors for providing fuel to said combustion chamber;

wherein at least one of said fuel injectors produces a crescent-shaped flame pattern in said combustion chamber, said flame pattern having an overlap with a flame pattern from an adjacent one of fuel injectors.

24. A burner section of a gas turbine engine, comprising:

a combustion chamber having a recirculation zone; and a plurality of fuel injectors for providing fuel to said combustion chamber;

wherein at least one of said fuel injectors produces a skewed flame pattern in said combustion chamber, said flame pattern having an overlap with a flame pattern from an adjacent one of fuel injectors, and said skewed flame pattern having a peak flame concentration adjacent said recirculation zone.

25. A method of improving stability of a flame in a burner section of a gas turbine engine, comprising the steps of:

providing a plurality of fuel injectors, at least one of said fuel injectors having a primary circuit and a secondary circuit;

supplying fuel to said fuel injectors so that said primary circuit of said fuel injector produces a skewed flame pattern in the burner section, said skewed flame pattern creating a fuel non-uniformity in the burner section; and overlapping said skewed flame pattern with a flame pattern of an adjacent one of said fuel injectors.

26. A method of improving stability of a flame in a burner section of a gas turbine engine, comprising the steps of:

providing a plurality of fuel injectors;

supplying fuel to said fuel injectors so that at least one of said fuel injectors produce a skewed flame pattern in the burner section, said skewed flame pattern having a peak flame concentration and creating a fuel non-uniformity in the burner section;

overlapping said skewed flame pattern with a flame pattern of an adjacent one of said fuel injectors; and placing said peak flame concentration adjacent an overlap between said skewed flame patterns.

* * * * *